US009587884B2

(12) United States Patent
Kosugi et al.

(10) Patent No.: US 9,587,884 B2
(45) Date of Patent: Mar. 7, 2017

(54) INSULATION STRUCTURE AND METHOD OF MANUFACTURING SEMICONDUCTOR DEVICE

(71) Applicant: Hitachi Kokusai Electric Inc., Tokyo (JP)

(72) Inventors: Tetsuya Kosugi, Toyama (JP); Motoya Takewaki, Toyama (JP); Hitoshi Murata, Toyama (JP); Masaaki Ueno, Toyama (JP)

(73) Assignee: HITACHI KOKUSAI ELECTRIC INC., Tokyo (JP)

( * ) Notice: Subject to any disclaimer, the term of this patent is extended or adjusted under 35 U.S.C. 154(b) by 528 days.

(21) Appl. No.: 14/223,367

(22) Filed: Mar. 24, 2014

(65) Prior Publication Data

US 2014/0287375 A1 Sep. 25, 2014

(30) Foreign Application Priority Data

Mar. 25, 2013 (JP) ..... 2013-061682
Feb. 21, 2014 (JP) ..... 2014-031545

(51) Int. Cl.
*F27D 9/00* (2006.01)
*F27B 17/00* (2006.01)

(52) U.S. Cl.
CPC ..... *F27D 9/00* (2013.01); *F27B 17/0025* (2013.01)

(58) Field of Classification Search
CPC ..... F27D 9/00; F27D 2009/0002; F27D 2009/007; F27D 2009/0005; F27D 2009/001; F27D 2009/0067; F27B 17/0025
USPC ..... 165/135, 59; 432/233; 438/795
See application file for complete search history.

(56) References Cited

U.S. PATENT DOCUMENTS 4,954,684 A * 9/1990 Aoki ..... C21D 9/0018 118/50.1
6,283,749 B1 * 9/2001 Bernard, Jr. ..... F27B 17/0083 373/112
7,700,156 B2 * 4/2010 Aoki ..... H01L 21/02238 427/248.1
7,835,816 B2 * 11/2010 Kataoka ..... G05B 11/42 700/207
2001/0016306 A1 * 8/2001 Vader ..... C23C 16/45561 432/2

(Continued)

FOREIGN PATENT DOCUMENTS

JP 2011-103469 A 5/2011
JP 2012-033871 A 2/2012
WO 2008/099449 A1 8/2008

*Primary Examiner* — Mohammad M Ali
(74) *Attorney, Agent, or Firm* — Volpe and Koenig, P.C.

(57) ABSTRACT

A heat insulation structure, which has a cylindrical side wall part formed in a multilayer structure, includes: a cooling gas supply port provided in an upper portion of a side wall outer layer disposed in an outer side of the side wall part; a cooling gas passage provided between a side wall inner layer disposed in an inner side of the side wall part and the side wall outer layer; a space provided in an inner side of the side wall inner layer; a plurality of blowout holes provided in the side wall inner layer for distributing cooling gas from the cooling gas passage to the space; a buffer area continuously provided in the cooling gas supply port and the cooling gas passage; and a throttle part configured to reduce a cross-sectional area of a boundary surface between the buffer area and the cooling gas passage.

20 Claims, 16 Drawing Sheets

(56) References Cited

U.S. PATENT DOCUMENTS

| | | | | |
|---|---|---|---|---|
| 2008/0153314 | A1* | 6/2008 | Hayashida | H01L 21/67109 438/795 |
| 2008/0296282 | A1* | 12/2008 | Kobayashi | F27B 17/0025 219/385 |
| 2009/0194521 | A1* | 8/2009 | Kobayashi | F27B 17/0025 219/520 |
| 2009/0197352 | A1* | 8/2009 | Ueno | C23C 16/46 438/5 |
| 2012/0006506 | A1* | 1/2012 | Murata | C23C 16/46 165/59 |

* cited by examiner

INSULATION STRUCTURE AND METHOD OF MANUFACTURING SEMICONDUCTOR DEVICE

BACKGROUND

Technical Field

The present invention relates to a heat insulation structure and a method of manufacturing a semiconductor device.

Related Art

As an example of a substrate processing apparatus, there is a semiconductor manufacturing apparatus. As an example of a semiconductor manufacturing apparatus, a vertical diffusion/chemical vapor deposition (CVD) apparatus is known.

In the vertical diffusion/CVD apparatus, processing is performed on a semiconductor or glass substrate under heating. For example, a substrate is accommodated in a vertical reaction furnace and is heated while supplying reaction gas. In this way, a thin film is vapor-phase-grown on the substrate. In this type of the semiconductor manufacturing apparatus, in order to cool a heat generation portion being a heating device and discharge heat to the outside of the apparatus body, WO 2008/099449 A discloses a heating device including a cooling gas supply port disposed in an upper portion of a side wall outer layer disposed in an outer side among multiple layers of a cylindrical side wall part, a cooling gas passage disposed between the side wall outer layer and a side wall inner layer disposed in an inner side among the multiple layers of the side wall part, a space provided inside the side wall inner layer, and a plurality of blowout holes disposed in a portion of the side wall inner layer below the cooling gas supply port so as to blow out cooling gas from the cooling gas passage to the space, whereby the cooling gas is introduced into the space. Further, JP 4104070 B1 discloses a configuration in which a cooling gas introduction duct is provided to surround a cylindrical space and a lower portion of a heat generation part at a lower end of an outer side heat insulation part, such that cooling gas is introduced to the space from the cooling gas introduction duct. Further, JP 2012-33871 A discloses a configuration in which a cooling gas introduction part is provided in an upper side of a heat insulation part to connect to a cylindrical space by way of surrounding the heat generation portion.

SUMMARY

However, when heat treatment is performed in the above-described substrate processing apparatus, productivity is improved as a recipe time is shorter in a series of loading a boat mounted with a room-temperature substrate into a high-temperature furnace, performing heat treatment after raising a temperature to a predetermined temperature, lowering a temperature, and unloading the boat mounted with the substrate from the furnace. That is, a recovery characteristic until reaching each target temperature is important in reducing a recipe. In order to improve a temperature recovery characteristic at the time of boat up or a recovery characteristic at the time of raising/lowering a temperature, it is necessary for a heating device to have a good heat dissipation characteristic. Further, when cooling air flows into the furnace, the substrate is locally cooled and it is difficult to maintain a temperature uniformity at the substrate or between the substrates.

It is an object of the present invention to solve the above problems and provide a heat insulation structure and a method of manufacturing a semiconductor device, which are capable of improving throughput by quickly lowering a furnace temperature while improving a temperature uniformity at the substrate or between the substrates.

According to an aspect of the present invention, there is provided a heat insulation structure, which has a cylindrical side wall part formed in a multilayer structure, the heat insulation structure including: a cooling gas supply port provided in an upper portion of a side wall outer layer disposed in an outer side of the side wall part; a cooling gas passage provided between a side wall inner layer disposed in an inner side of the side wall part and the side wall outer layer; a space provided in an inner side of the side wall inner layer; a plurality of blowout holes provided in the side wall inner layer to blow out cooling gas from the cooling gas passage to the space; a buffer area continuously provided in the cooling gas supply port and the cooling gas passage; and a throttle part configured to reduce a cross-sectional area of a boundary surface between the buffer area and the cooling gas passage.

According to another aspect of the present invention, there is provided a heat insulation structure, which has a cylindrical side wall part formed in a multilayer structure, the heat insulation structure including: a cooling gas supply port provided in an upper portion of a side wall outer layer disposed in an outer side of the side wall part; a cooling gas passage provided between a side wall inner layer disposed in an inner side of the side wall part and the side wall outer layer; a cooling gas outlet port provided in a lower portion of the side wall outer layer disposed in the outer side of the side wall part; a buffer area provided on both ends of the cooling gas passage; and a throttle part configured to reduce a cross-sectional area of a boundary surface disposed in a boundary between the buffer area and the cooling gas passage.

According to another aspect of the present invention, there is provided a method of manufacturing a semiconductor device, including: loading a substrate into a reaction tube; processing the substrate inside the reaction tube; and, after the processing, cooling the reaction tube disposed in a space provided in an inner side of the side wall inner layer, by blowing out cooling gas, the cooling gas being supplied from a cooling gas supply port disposed in an upper portion of a side wall outer layer disposed in an outer side of a side wall part of a heat insulation structure having the cylindrical side wall part formed in a multilayer structure, from a plurality of blowout holes to the space provided in the inner side of the side wall inner layer, through a cooling gas passage provided between a side wall inner layer disposed in an inner side of the side wall part and the side wall outer layer, a buffer area continuously provided in the cooling gas supply port and the cooling gas passage, and a throttle part configured to reduce a cross-sectional area of a boundary surface disposed in a boundary between the buffer area and the cooling gas passage.

According to another aspect of the present invention, there is provided a method for manufacturing a semiconductor device, including: loading a substrate into a reaction tube; processing the substrate inside the reaction tube; and, after the processing, discharging cooling gas, the cooling gas being supplied from a cooling gas supply port disposed in an upper portion of a side wall outer layer disposed in an outer side of a side wall part of a heat insulation structure having the cylindrical side wall part formed in a multilayer structure, from a cooling gas outlet port provided in a lower portion of the side wall outer layer, through a cooling gas passage provided between a side wall inner layer disposed in an inner side of the side wall part and the side wall outer layer, a buffer area provided on both ends of the cooling gas passage, and a throttle part configured to reduce a cross-sectional area of a boundary surface disposed in a boundary between the buffer area and the cooling gas passage.

According to the present invention, there are provided a heat insulation structure and a method of manufacturing a semiconductor device, which are capable of improving throughput by quickly lowering a furnace temperature while improving a temperature uniformity at the substrate or between the substrates.

BRIEF DESCRIPTION OF DRAWINGS

FIGS. 2A to 2E are longitudinal sectional views of the substrate processing apparatus illustrated in FIG. 1, wherein FIG. 2A is a longitudinal sectional view taken along line A-A, FIG. 2B is a longitudinal sectional view taken along line B-B, FIG. 2C is a longitudinal sectional view taken along line C-C, FIG. 2D is a longitudinal sectional view taken along line D-D, and FIG. 2E is a longitudinal sectional view taken along line E-E;

FIGS. 10A and 10B illustrate substrate processing apparatuses having heating devices with different heat dissipation characteristics according to comparative examples, wherein FIG. 10A is a diagram illustrating a heating device with a thin side wall heat insulation part, and FIG. 10B is a diagram illustrating a heating device with a thick side wall heat insulation part;

DETAILED DESCRIPTION

A substrate processing apparatus 10 according to an embodiment of the present invention will be described with reference to FIGS. 1 and 2.

Figure 1:
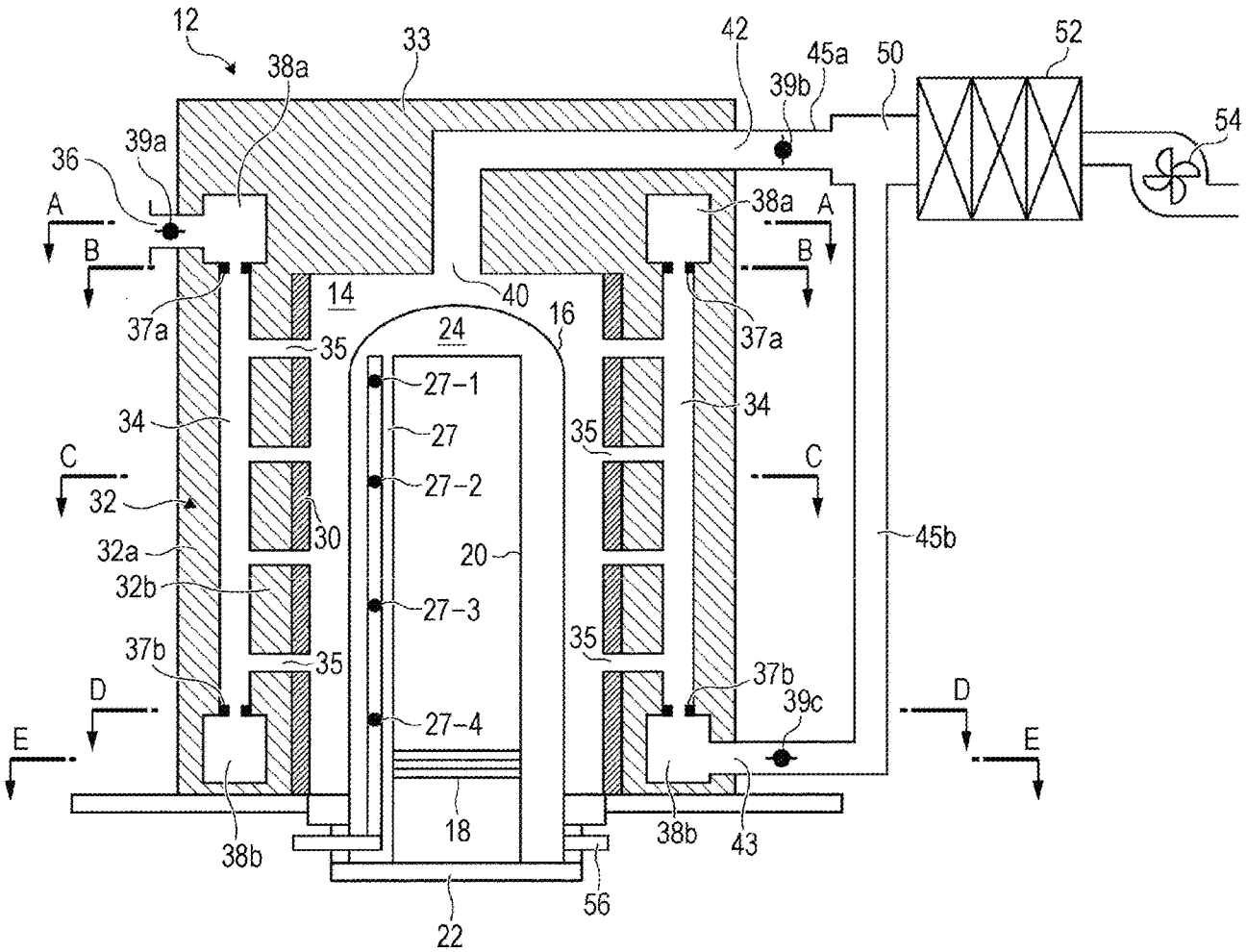
FIG. 1 is a cross-sectional view illustrating a substrate processing apparatus according to an embodiment of the present invention.

As illustrated in FIG. 1, the substrate processing apparatus 10 according to the embodiment of the present invention includes a cylindrical heating device 12, a cylindrical reaction tube 16 accommodated in the inside of the heating device 12 and having a furnace inner space 14, and a boat 20 configured to hold a substrate 18 to be processed in the inside of the reaction tube 16. The boat 20 can be charged with a plurality of substrates 18 in a horizontal position in multiple stages with a gap therebetween, and holds the plurality of substrates 18 within the reaction tube 16 in this state. The boat 20 is placed on an elevator (not illustrated) through a boat cap 22, and can be moved up and down by the elevator. Therefore, charging the substrates 18 into the reaction tube 16 and discharging the substrates 18 from the reaction tube 16 are performed by the operation of the elevator. Further, the reaction tube 16 forms a process chamber 24 to accommodate the substrates 18, a gas introduction pipe (not illustrated) communicates with the inside of the reaction tube 16, and a reaction gas supply source (not illustrated) is connected to the gas introduction pipe. Further, a gas exhaust pipe 56 communicates with the inside of the reaction tube 16 to exhaust the inside of the process chamber 24.

The heating device 12 has a cylindrical shape and further includes a heat generation part 30 configured to heat the furnace inner space 14 in the inside of a heat insulation structure in which a plurality of heat insulators is stacked.

The heat insulation structure includes a side wall part 32 as a heat insulation part formed to have a cylindrical shape, and an upper wall part 33 as a heat insulation part formed to cover an upper end of the side wall part 32.

The side wall part 32 is formed to have a multilayer structure, and includes a side wall outer layer 32*a* formed in an outer side among the plurality of layers of the side wall part 32, and a side wall inner layer 32*b* formed in an inner side among the plurality of layers of the side wall part 32. A cylindrical space 34 as a cooling gas passage is formed between the side wall outer layer 32*a* and the side wall inner layer 32*b*. Therefore, the heat generation part 30 is provided in the inside of the side wall inner layer, and the inside of the heat generation part 30 is a heat generation area. Further, the side wall part 32 has a structure in which a plurality of heat insulators is stacked, but it is obvious that the side wall part 32 is not limited thereto.

A cooling gas supply port 36 is formed in an upper portion of the side wall outer layer 32*a*.

Further, a cooling gas outlet port 43 is formed in a lower portion of the side wall outer layer 32*a*.

Figure 2A:
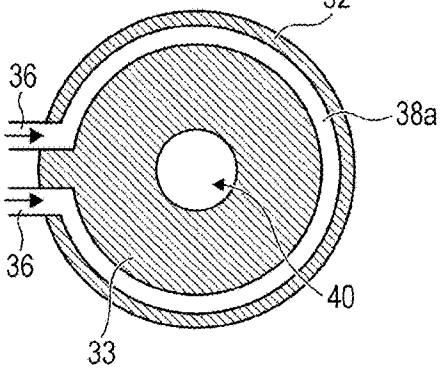

As illustrated in FIG. 2A, a duct 38*a* is formed in a substantially horizontal direction of the cooling gas supply port 36. The duct 38*a* is an upper end of the cylindrical space 34 and a buffer area communicating with the cooling gas supply port 36 and the cylindrical space 34. In the present embodiment, the cooling gas supply port 36 is provided in two places, but it is obvious that the cooling gas supply port 36 is not limited thereto.

The duct 38*a* is formed to be wider in a cross-sectional area than the cooling gas supply port 36 and the cylindrical space 34, and is provided to cover an upper portion of the heat generation part 30. Further, a rapid cooling outlet port 40 is provided in a central portion in a substantially horizontal direction of the cooling gas supply port 36.

Figure 2B:
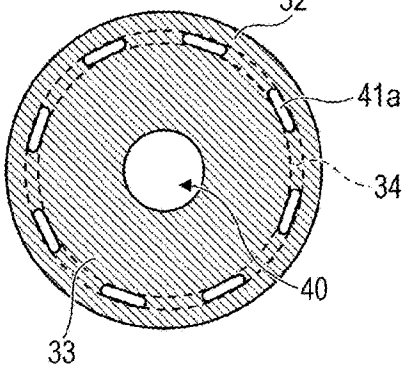
Figure 2C:
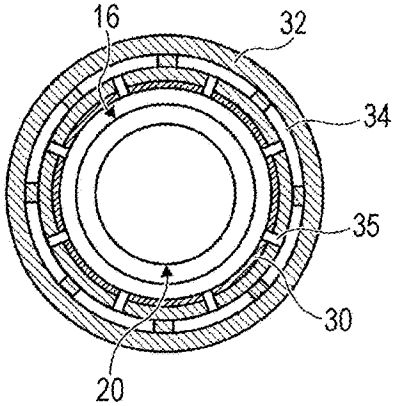
Figure 2D:
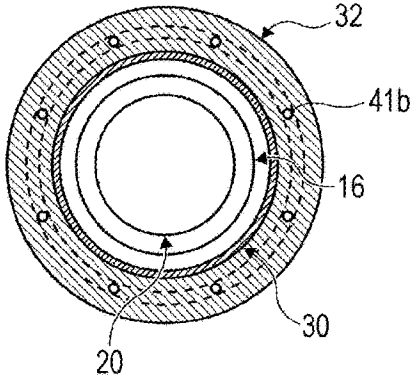
Figure 2E:
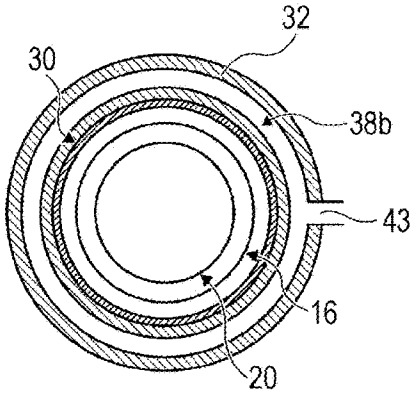

As illustrated in FIG. 2E, a duct 38*b* is formed in a substantially horizontal direction of the cooling gas outlet port 43. The duct 38*b* is a lower end of the cylindrical space 34 and a buffer area communicating with the cooling gas outlet port 43 and the cylindrical space 34.

The duct 38*b* is formed to be wider in a cross-sectional area than the cooling gas outlet port 43 and the cylindrical space 34, and is provided to cover a lower side portion of the heat generation part 30.

That is, the ducts 38*a* and 38*b* as the buffer areas formed to be wider than the cylindrical space 34 are provided on both ends of the cylindrical space 34.

Further, a throttle part 37*a* is provided in a boundary between the duct 38*a* and the cylindrical space 34. The throttle part 37*a* reduces a flow rate of cooling gas by throttling the cooling gas passage being the cylindrical space 34 (by reducing the cross-sectional area of the cooling gas passage). That is, as illustrated in FIG. 2B, a plurality of throttle holes 41*a* is equally formed in a circumferential direction in a boundary surface between the duct 38*a* and the cylindrical space 34.

Further, a throttle part 37*b* is provided in a boundary between the duct 38*b* and the cylindrical space 34. The throttle part 37*b* reduces a flow rate of cooling gas by throttling the cooling gas passage being the cylindrical space 34 (by reducing the cross-sectional area of the cooling gas passage). That is, as illustrated in FIG. 2D, a plurality of throttle holes 41*b* is equally formed in a circumferential direction in a boundary surface between the duct 38*b* and the cylindrical space 34.

Further, a cross-sectional area of the throttle hole 41*a* is formed to be larger than a cross-sectional area of the throttle hole 41*b*.

Further, the plurality of throttle holes 41*a* is formed such that the sum of the cross-sectional areas of the plurality of throttle holes 41*a* is smaller than the cross-sectional area of the duct 38*a*. Further, the plurality of throttle holes 41*b* is formed such that the sum of the cross-sectional areas of the plurality of throttle holes 41*b* is smaller than the cross-sectional area of the duct 38*b*. Since this reduces a flow rate variation of the cooling gas passing through the cylindrical space 34 on the circumference, an in-plane temperature uniformity characteristic of the substrate at the time of rapid cooling and temperature recovery to be described below can be improved.

Further, the cross-sectional areas of the throttle holes 41*a* and 41*b* are adjusted to a size optimal to the uniform flow of the cooling gas passing through at least the cylindrical space 34.

Further, as illustrated in FIG. 2C, a plurality of blowout holes 35 communicating the cylindrical space 34 and the furnace inner space 14 is formed in a required distribution in the side wall inner layer 32*b* under the cooling gas supply port 36. As illustrated in FIG. 1, the plurality of blowout holes 35 communicates the cylindrical space 34 and the furnace inner space 14 in a substantially horizontal direction. That is, the plurality of blowout holes 35 is configured to blow out the cooling gas from the cylindrical space 34 to the furnace inner space 14. Further, it is preferable that the cross-sectional areas of the throttle holes 41*a* and 41*b* are adjusted to a size or position optimal to the blowout of the cooling gas from the blowout holes 35. Further, the blowout holes 35 are formed in a horizontal direction as illustrated in FIG. 1, but the blowout holes 35 are not limited thereto. For example, the blowout holes 35 may be inclined toward the rapid cooling outlet port 40.

As illustrated in FIGS. 2A and 2B, the circular rapid cooling outlet port 40 is formed in the upper wall part 33, and the rapid cooling outlet port 40 is disposed on a central axis of the heating device 12. Further, a rapid cooling gas outlet port 42 is formed above the duct 38*a* on a lateral surface of the upper wall part 33 and communicates with the rapid cooling outlet port 40. Herein, since the duct 38*b* is provided under the rapid cooling outlet port 40, it is possible to eliminate the flow of the cooling gas into the furnace and to improve a substrate temperature drift during furnace temperature stability and a temperature uniformity at the substrate or between the substrates.

As illustrated in FIG. 1, the throttle part 37*a* is provided above the blowout hole 35 disposed at the top, and the throttle part 37*b* is provided below the blowout hole 35 disposed at the bottom. Further, the throttle parts 37*a* and 37*b* are provided below the rapid cooling outlet port 40.

Further, the rapid cooling gas outlet port 42 and the cooling gas outlet port 43 are connected to exhaust pipes 45*a* and 45*b*, respectively, and are joined at a duct 50. A radiator 52 and an exhaust fan 54 are connected to the duct 50 in this order from an upstream side. The cooling gas heated in the inside of the heating device 12 is discharged to the outside of the apparatus through the duct 50, the radiator 52, and the exhaust fan 54.

Herein, an on-off valve 39*a* is provided in the vicinity of the cooling gas supply port 36 and the duct 38*a*. Further, an on-off valve 39*b* is provided in the vicinity of the rapid cooling gas outlet port 42 and the duct 50. Further, an on-off valve 39*c* is provided in the vicinity of the cooling gas outlet port 43 and the duct 38*b*. Therefore, by providing the valves 39*b* and 39*c* in the vicinity of the duct 50 or the duct 38*b*, it is possible to reduce the influence of convection flow from the duct at the outlet port when not in use and to improve the temperature uniformity at the substrate around the duct.

Furthermore, the supply of the cooling gas is manipulated by the opening/closing of the valve 39*a* and ON/OFF of the exhaust fan 54, and the cooling gas passage 34 is closed and opened by the opening/closing of the valve 39*b* or the valve 39*c* and ON/OFF of the exhaust fan 54. The cooling gas is discharged from each of the rapid cooling gas outlet port 42 or the cooling gas outlet port 43.

Figure 3:
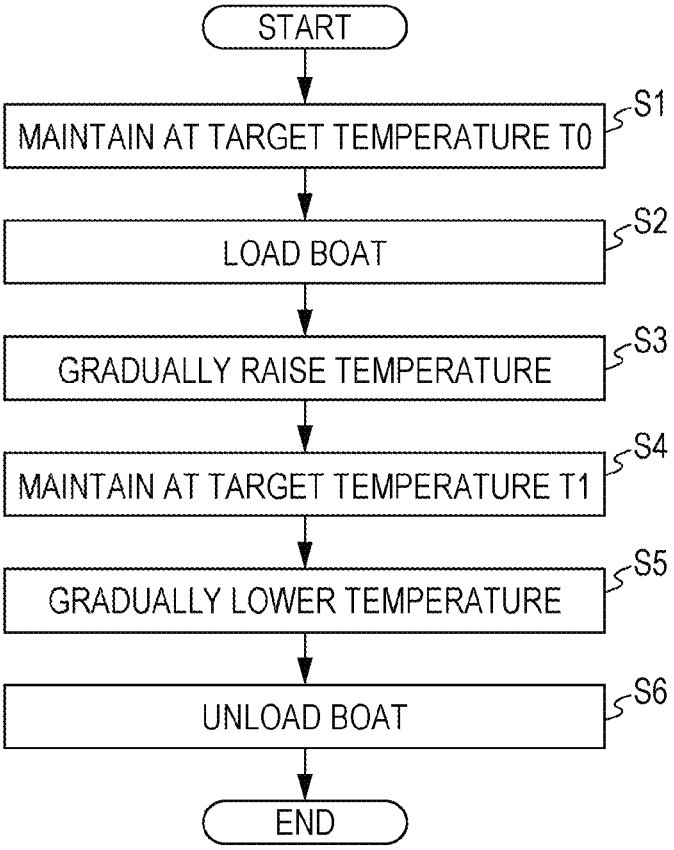
FIG. 3 is a flowchart illustrating an example of a temperature-related process among film forming processes according to an embodiment of the present invention.
Figure 4:
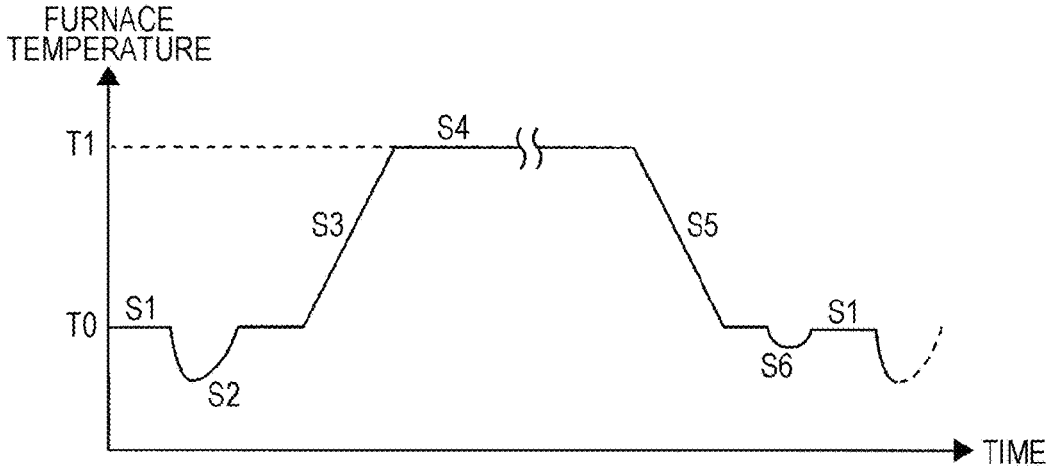
FIG. 4 is a diagram of a change in a furnace temperature in the flowchart illustrated in FIG. 3.

Next, an example of film forming processes performed in a heat treatment apparatus (substrate processing apparatus 10) will be described with reference to FIGS. 3 and 4. FIG. 3 is a flowchart illustrating an example of a temperature-related process among film forming processes performed in the heat treatment apparatus, and FIG. 4 schematically illustrates a change in a furnace temperature. Reference symbols S1 to S6 of FIG. 4 indicate that steps S1 to S6 of FIG. 3 are performed, respectively.

Step S1 is a process of stabilizing the furnace temperature at a relatively low temperature T0. In step S1, the substrate 18 is not yet inserted into the furnace.

Step S2 is a process of inserting the substrate 18 held in the boat 20 into the furnace. The temperature of the substrate 18 is lower than the furnace temperature T0 at this point of time. Therefore, as the result of inserting the substrate 18 into the furnace, the furnace temperature is temporarily lower than T0. However, the furnace temperature is stabilized again at the temperature T0 after some time by a temperature control device 74 or the like which is to be described below.

Step S3 is a process of gradually raising the furnace temperature from the temperature T0 to a target temperature T1 at which the film forming process is to be performed on the substrate 18.

Step S4 is a process of stabilizing the furnace temperature at the target temperature T1 so as to perform the film forming process on the substrate 18.

Step S5 is a process of gradually lowering the furnace temperature from the temperature T1 to the relatively low temperature T0 after the film forming process has been completed.

Step S6 is a process of unloading the substrate 18, on which the film forming process has been performed, along with the boat 20.

When an unprocessed substrate 18 to be subjected to the film forming process remains, the processed substrate 18 on the boat 20 is replaced with the unprocessed substrate 18, and a series of processes of steps S1 to S6 are repeated.

The processes of steps S1 to S6 proceed to next steps after the furnace temperature is in a predefined fine temperature range with respect to all target temperatures, and a stable state in which that state is continuously kept is obtained for a predetermined time. Alternatively, recently, the processes proceed to next steps in steps S1, S2, S5 and S6 before obtaining the stable state, so as to increase the number of substrates 18 on which the film forming process is performed in a predetermined time.

In the reaction tube 16, a detection part 27 configured to detect the furnace temperature is provided in parallel to the boat 20. The detection part 27 includes, for example, four temperature sensors, that is, a temperature sensor 27-1, a temperature sensor 27-2, a temperature sensor 27-3, and a temperature sensor 27-4 in this order from the upper end.

Herein, a process in a case where the furnace temperature is appropriate will be described.

Figure 5:
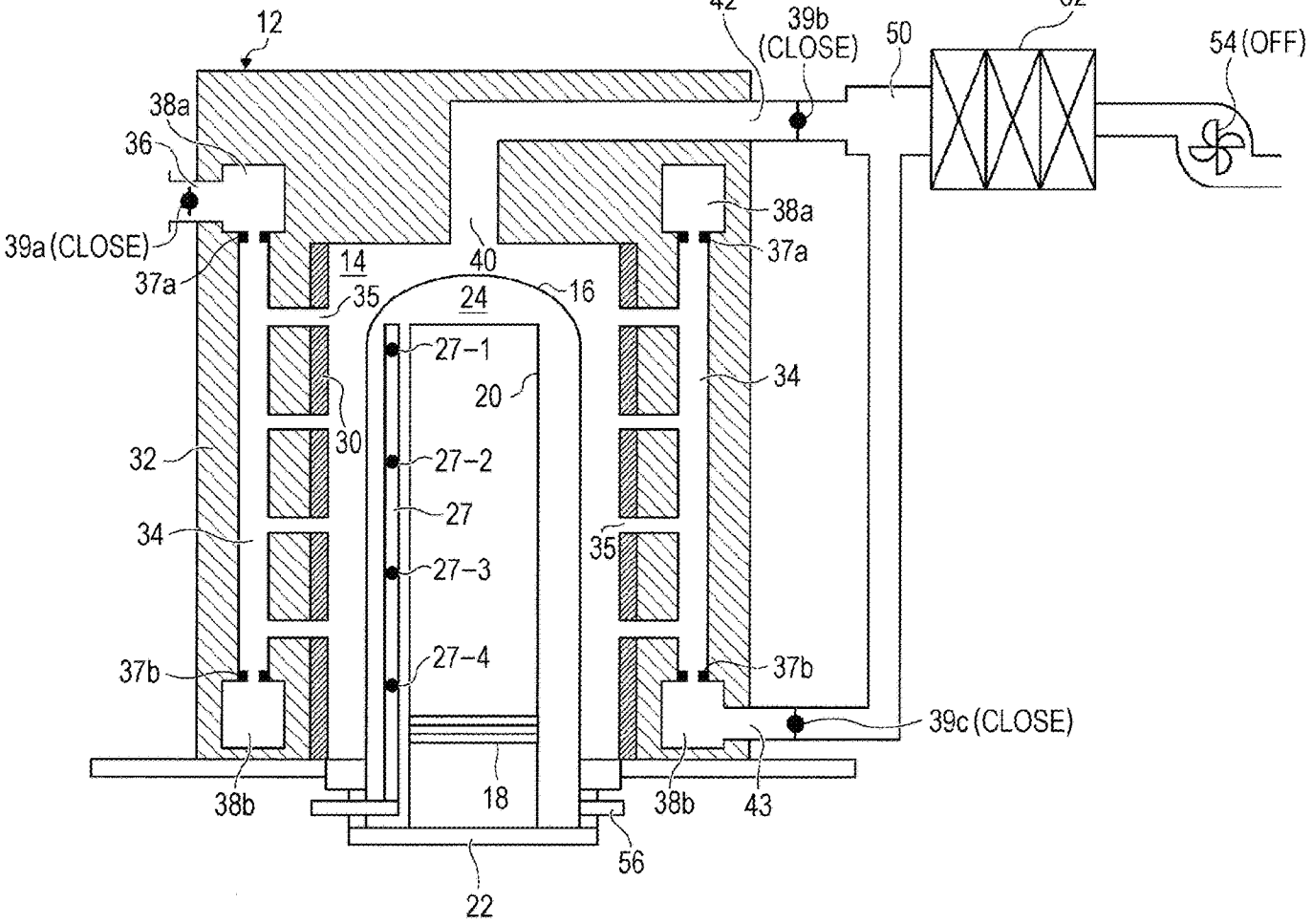
FIG. 5 is a cross-sectional view describing valve control and an air flow at the time of temperature stability in the substrate processing apparatus according to the embodiment of the present invention.

FIG. 5 illustrates a state of the furnace in a case where the furnace temperature is stable. In FIG. 5, the same reference numerals as those of FIG. 1 are assigned to the same elements as those of FIG. 1, and a description thereof is omitted herein.

In a case where the furnace temperature is appropriate and stable, the valves 39*a*, 39*b* and 39*c* are all closed, and the exhaust fan 54 is also stopped (furnace temperature stability control state). At this time, an energy saving effect is high when the cooling gas of the cylindrical space 34 being the cooling gas passage is in a stationary state. That is, this is the state of step S4 in FIGS. 3 and 4.

Next, a rapid cooling process in a case where the furnace temperature is rapidly cooled will be described.

Figure 6:
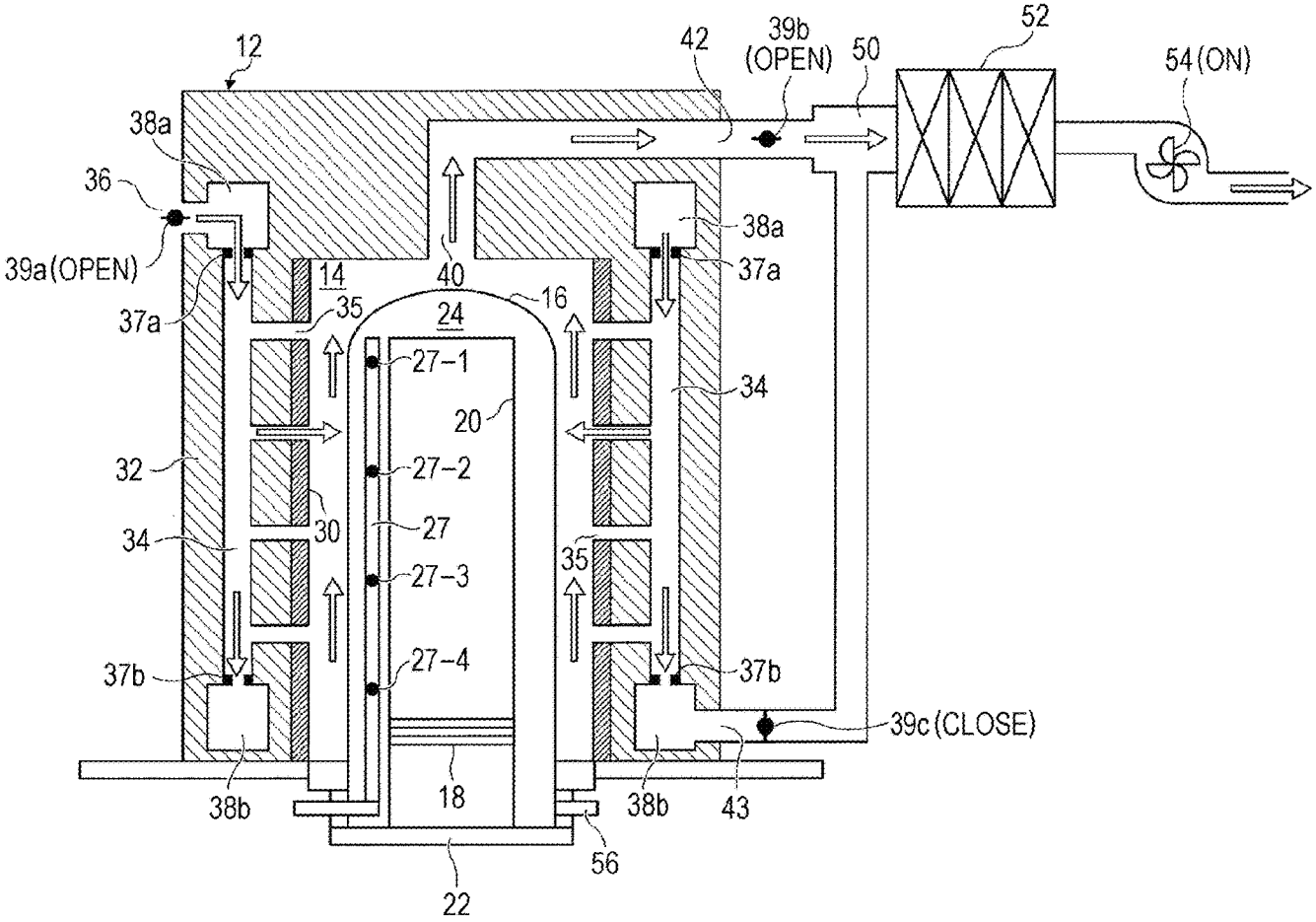
FIG. 6 is a cross-sectional view describing valve control and an air flow at the time of rapid cooling in the substrate processing apparatus according to the embodiment of the present invention.

FIG. 6 illustrates a state of the furnace at the time of rapid cooling. In FIG. 6, the same reference numerals as those of FIG. 1 are assigned to the same elements as those of FIG. 1, and a description thereof is omitted herein.

At the time of rapid cooling, the exhaust fan 54 is operated by closing the valve 39*c* and opening the valve 39*a* and the valve 39*b* (rapid cooling control state). The cooling gas supplied from the cooling gas supply port 36 is uniformized in the throttle part 37*a* through the duct 38*a* and is then introduced into the cylindrical space 34. The cooling gas introduced into the cylindrical space 34 moves down in the cylindrical space 34 and is introduced into the furnace inner space 14 through the blowout holes 35. The cooling gas introduced into the furnace inner space 14 moves up in the furnace inner space 14 and is discharged from the rapid cooling gas outlet port 42 through the rapid cooling outlet port 40, and the heat generation part 30 is cooled from both the outer surface and the inner surface. That is, the cooling gas heated in the inside of the heating device 12 is discharged to the outside through the rapid cooling gas outlet port 42, and the temperature inside the heating device 12 is also lowered. Therefore, the temperature inside the reaction tube 16 is lowered. That is, this is the state of step S5 in FIGS. 3 and 4.

Next, a process in a case where the furnace temperature is recovered will be described.

Figure 7:
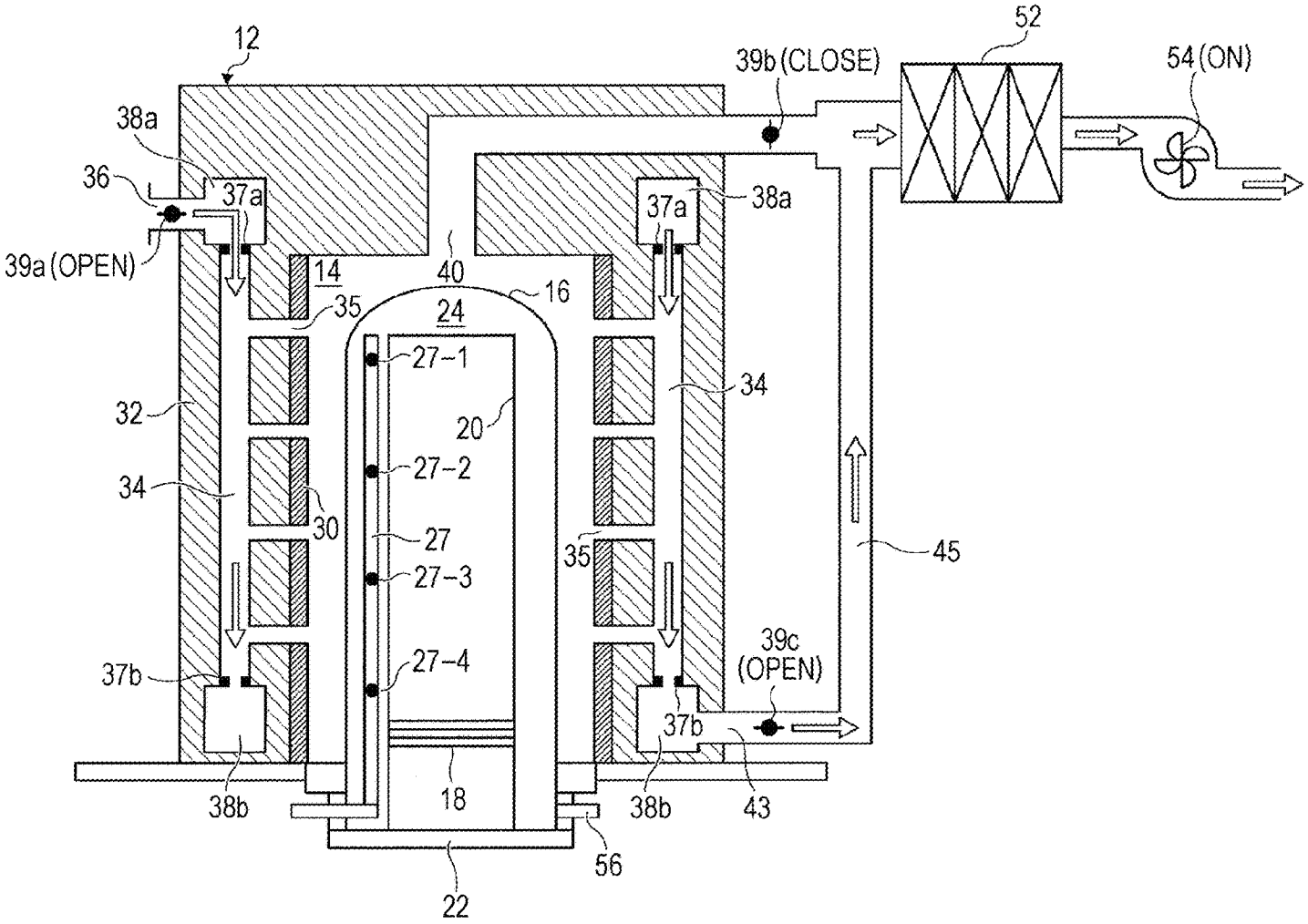
FIG. 7 is a cross-sectional view describing valve control and an air flow at the time of temperature recovery in the substrate processing apparatus according to the embodiment of the present invention.

FIG. 7 illustrates a state of the furnace at the time of temperature recovery. In FIG. 7, the same reference numerals as those of FIG. 1 are assigned to the same elements as those of FIG. 1, and a description thereof is omitted herein.

At the time of temperature recovery, the exhaust fan 54 is operated by closing the valve 39*b* and opening the valve 39*a* and the valve 39*c* (temperature recovery control state). The cooling gas supplied from the cooling gas supply port 36 is uniformized in the throttle part 37*a* through the duct 38*a* and is then supplied to the cylindrical space 34. The cooling gas is uniformized in the throttle part 37*b*, without passing through the furnace inner space 14 and the rapid cooling outlet port 40, and is then discharged from the cooling gas outlet port 43 through the duct 38*b*. That is, the heat generation part 30 is cooled from the outer surface, and the heat insulation part 32 is cooled.

A control device 60 can maintain good substrate temperature uniformity and also achieve both the temperature recovery characteristic and the power consumption reduction by controlling and switching the opening/closing of the valves 39 and ON/OFF of the exhaust fan 54 according to a situation of the temperature control modes of the furnace temperature stability control state, the rapid cooling control state, and the temperature recovery control state illustrated in FIGS. 5 to 7.

Figure 8:
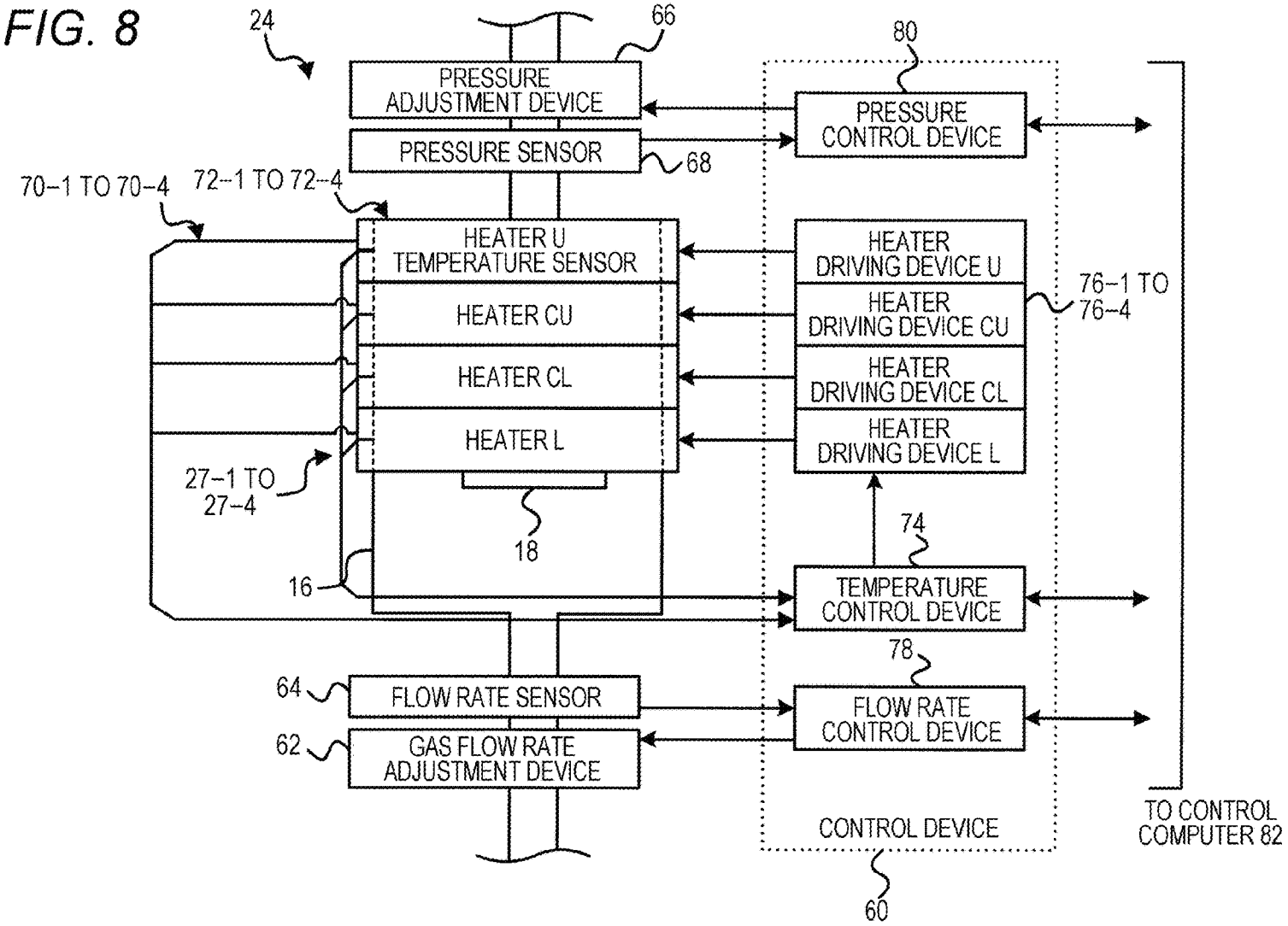
FIG. 8 is a diagram schematically illustrating a configuration of a control device and a relationship between the control device and a semiconductor manufacturing apparatus, in the substrate processing apparatus according to the embodiment of the present invention.

FIG. 8 is a diagram schematically illustrating a configuration of the control device 60 and a relationship between the control device 60 and the substrate processing apparatus 10.

As illustrated in FIG. 8, the process chamber 24 illustrated in FIGS. 5 to 7 includes first temperature sensors 27-1, 27-2, 27-3 and 27-4, second temperature sensors 70-1, 70-2, 70-3 and 70-4, a gas flow rate adjustment device 62, a flow rate sensor 64, a pressure adjustment device 66, and a pressure sensor 68.

The first temperature sensors 27-1, 27-2, 27-3 and 27-4 of the process chamber 24 are provided in temperature adjustment parts 72-1, 72-2, 72-3 and 72-4 of the heating device 12, respectively, and measure temperatures of positions corresponding to the temperature adjustment parts 72-1, 72-2, 72-3 and 72-4, respectively.

The second temperature sensors 70-1, 70-2, 70-3 and 70-4, for example, are provided corresponding to the temperature adjustment parts 72-1, 72-2, 72-3 and 72-4 in the cylindrical space 34, respectively, and measure the temperature distribution of the inside of the cylindrical space 34. Further, the arrangement positions of the second temperature sensors 70-1, 70-2, 70-3 and 70-4 are not limited to the cylindrical space 34. The second temperature sensors 70-1, 70-2, 70-3 and 70-4 may be arranged to be closer to the substrate 18 mounted on the boat 20 than at least the first temperature sensors.

The gas flow rate adjustment device 62 adjusts a flow rate of gas guided to the reaction tube 16 through a gas introduction nozzle (not illustrated).

The flow rate sensor 64 measures a flow rate of gas supplied to the reaction tube 16 through the gas introduction nozzle.

The pressure adjustment device 66 adjusts a pressure inside the reaction tube 16.

The pressure sensor 68 measures a pressure inside the reaction tube 16.

The control device 60 includes a temperature control device 74, four heater driving devices 76-1, 76-2, 76-3 and 76-4, a flow rate control device 78, and a pressure control device 80.

The control device 60 controls each element part of the semiconductor manufacturing apparatus as the substrate processing apparatus 10, based on setting values of a temperature, a pressure, and a flow rate, which are set from a control computer 82.

The temperature control device 74 controls power supplied to the temperature adjustment parts 72-1, 72-2, 72-3 and 72-4 by the heater driving devices 76-1, 76-2, 76-3 and 76-4, such that the temperatures of the temperature adjustment parts 72-1, 72-2, 72-3 and 72-4, which are measured by the first temperature sensors 27-1, 27-2, 27-3 and 27-4, become the temperatures set to the temperature adjustment parts 72-1, 72-2, 72-3 and 72-4 by the control computer 82.

The flow rate control device 78 controls a flow rate of gas introduced into the reaction tube 16 of the process chamber 24 by controlling the gas flow rate adjustment device 62 such that a value of a gas flow rate measured by the flow rate sensor 64 is equal to a value of a gas flow rate set by the control computer 82.

The pressure control device 80 controls a pressure inside the reaction tube 16 of the process chamber 24 by controlling the pressure adjustment device 66 such that a pressure inside the reaction tube, which is measured by the pressure sensor 68, is equal to a value of a pressure set by the control computer 82.

[Hardware Configuration]

Figure 9:
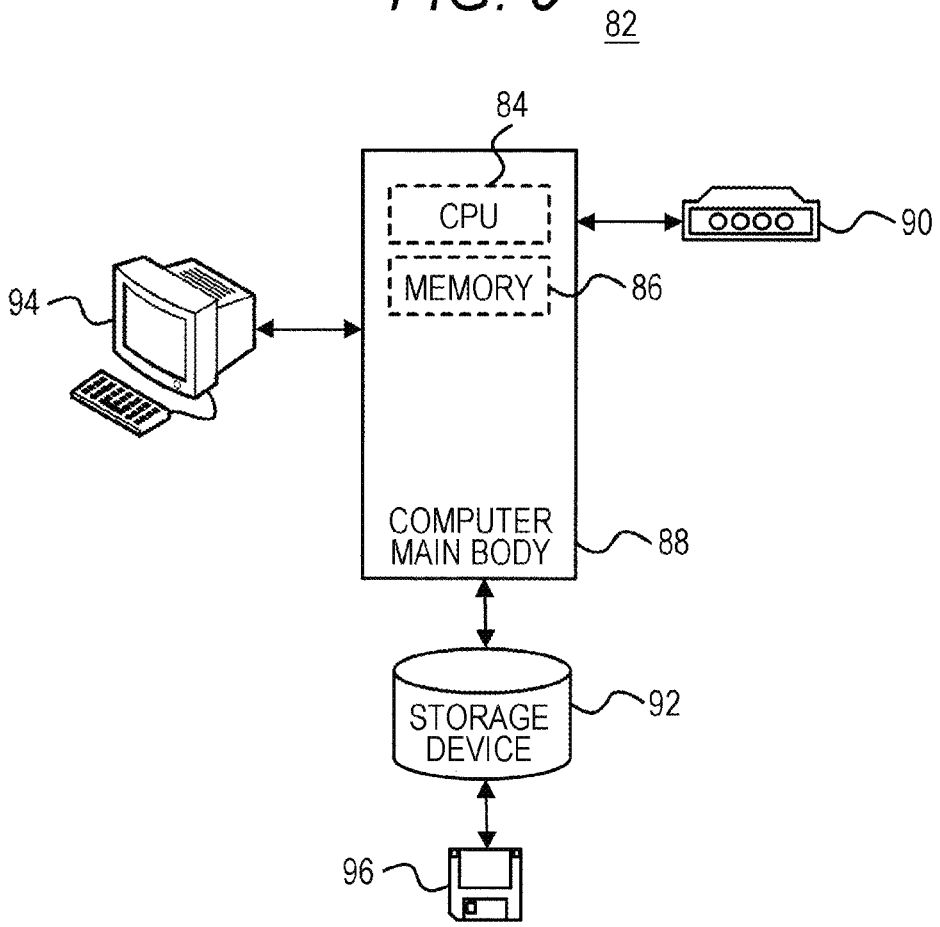
FIG. 9 is a diagram illustrating a hardware configuration of a control computer in the substrate processing apparatus according to the embodiment of the present invention.

FIG. 9 is a diagram illustrating a configuration of the control computer 82.

The control computer 82 includes a computer main body 88, a communication interface (IF) 90, a storage device 92, and a display/input device 94. The computer main body 88 includes a central processing unit (CPU) 84 and a memory 86.

That is, the control computer 82 includes element parts as a general computer.

The CPU constitutes the core of the operation unit, executes a control program stored in the storage device 92, and executes a recipe (for example, a process recipe) stored in the storage device 92 according to an instruction from the display/input device 94.

Further, a recording medium 96 stores an operation program or the like of the CPU. Examples of the recording medium 96 may include read only memory (ROM), electrically erasable programmable read only memory (EEPROM), flash memory, a hard disk, and the like. Herein, random access memory (RAM) functions as a working area of the CPU.

In the embodiment of the present invention, the control computer 82 has been described as an example, but the present invention is not limited thereto. The present invention can also be implemented using a general computer system. For example, the above-described processes can be executed by installing the program on a general-purpose computer from the recording medium 96, such as a flexible disk, a CD-ROM, or a USB, which stores the program for executing the above-described processes.

Further, the communication IF 90, such as a communication line, a communication network, or a communication system, may be used. In this case, for example, the corresponding program may be posted on a bulletin board of the communication network, and the program may be provided over a carrier wave through the network in a superimposed manner. Therefore, the above-described processes can be executed by starting and executing the provided program in the same manner as other programs under the control of an operating system (OS).

Next, substrate processing apparatuses according to comparative examples will be described.

Comparative Example 1

Figure 10B:
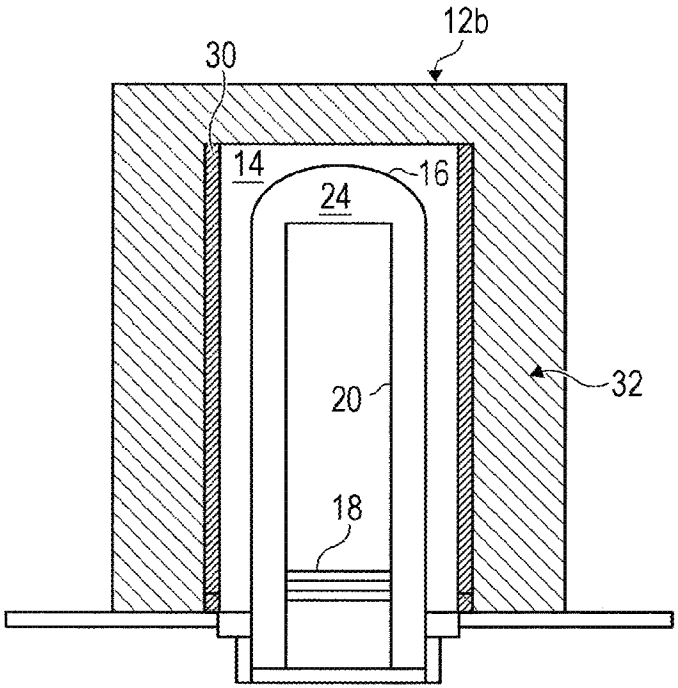
Figure 10A:
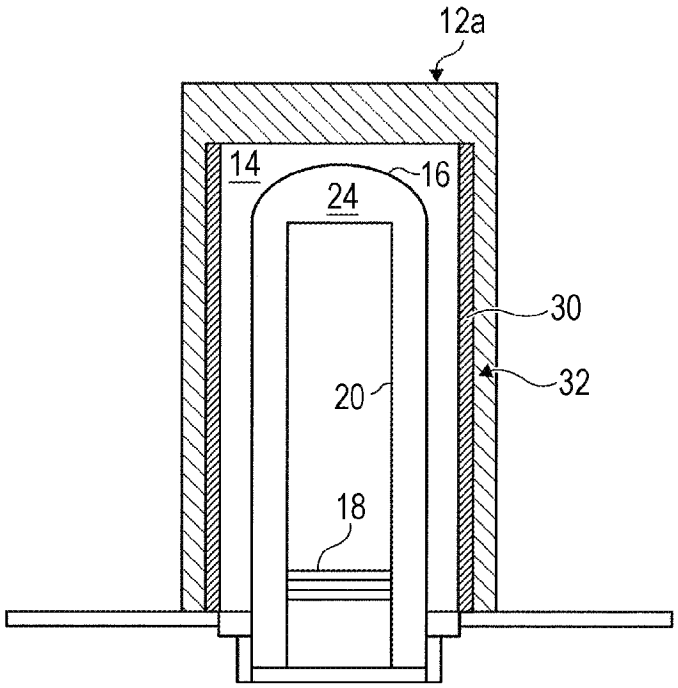

FIGS. 10A and 10B illustrate substrate processing apparatuses having heating devices with different heat dissipation characteristics. The heating device 12*a* of FIG. 10A has a thin side wall heat insulation part 32 and has good heat dissipation characteristic. On the other hand, the heating device 12*b* of FIG. 10B has a thick side wall heat insulation part 32 and has good heat insulation characteristic.

Figure 11:
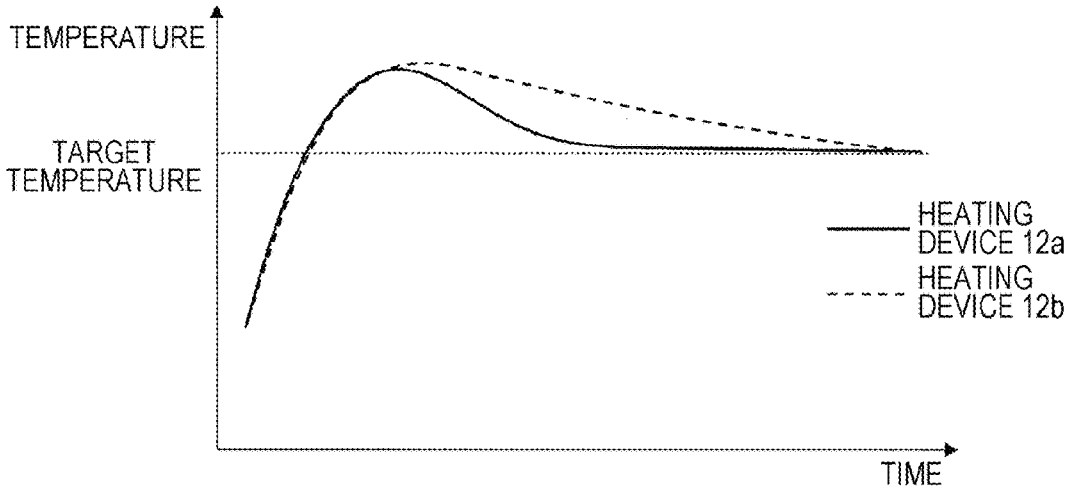
FIG. 11 is a diagram illustrating temperature recovery characteristics of the heating devices of FIGS. 10A and 10B.

FIG. 11 illustrates temperature recovery characteristics of the heating devices 12*a* and 12*b* of FIGS. 10A and 10B.

As illustrated in FIG. 11, since the side wall heat insulation part 32 of the heating device 12*a* is thin, the temperature decrease after overshoot is fast, and reaches the target temperature quickly. On the other hand, in the heating device 12*b*, the temperature decrease after overshoot is slow, and reaches the target temperature slowly.

Further, in the case of the heating device 12*a* having good heat dissipation characteristic, the power consumption necessary for stabilizing the temperature is increased as compared with the heating device 12*b*. Furthermore, energy of peripheral devices for processing heat dissipation from the surface of the heating device is also needed. In the past, the thickness of the side wall heat insulation part 32 has been determined and the heating device has been designed, considering balance of the temperature recovery characteristic and the power consumption. This method sacrifices either balance of the temperature recovery characteristic or the power consumption, or provides moderate performances to both sides. In the case of this method, it was difficult to obtain high performances on both sides.

Comparative Example 2

Figure 12:
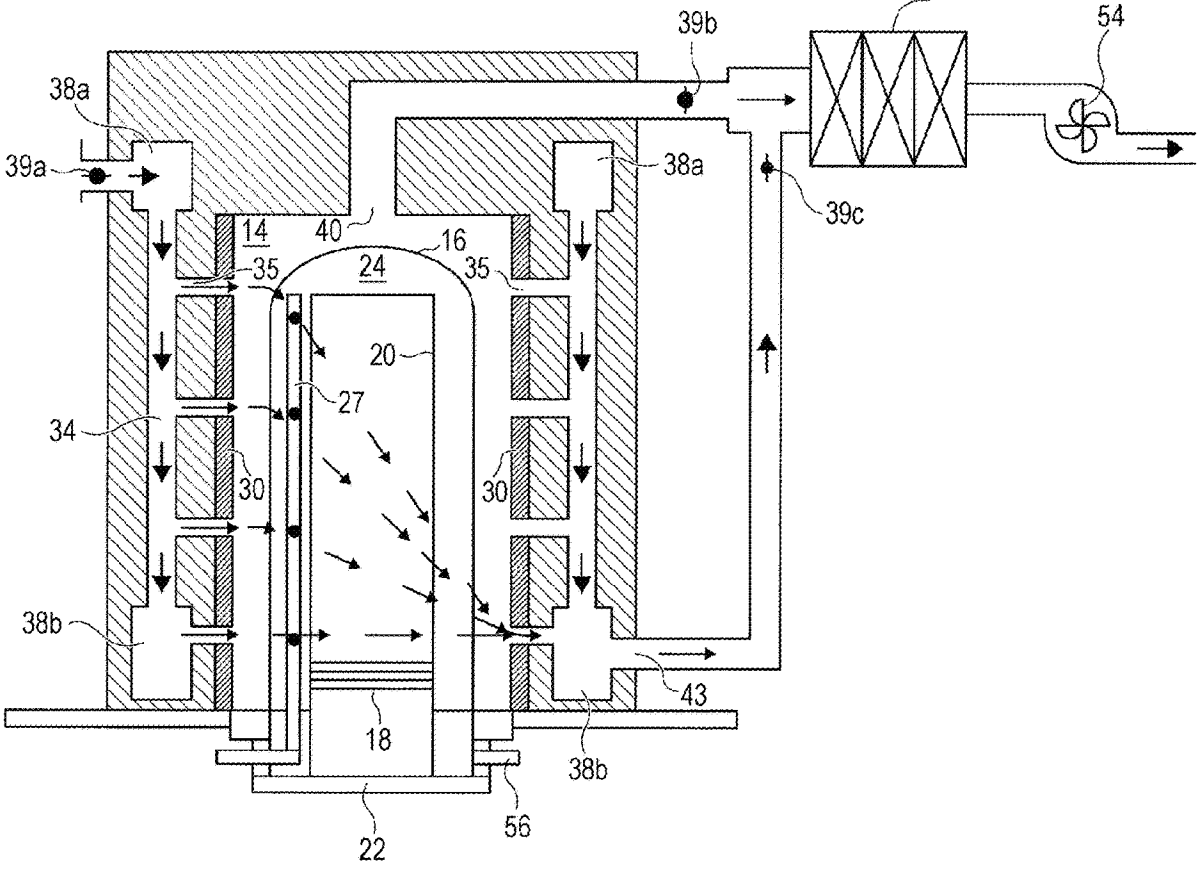
FIG. 12 is a cross-sectional view describing an air flow in the substrate processing apparatus according to the comparative example.

FIG. 12 illustrates a substrate processing apparatus 100 according to a second comparative example.

The substrate processing apparatus 100 differs from the substrate processing apparatus 10 according to the embodiment of the present invention, in that the throttle parts 37*a* and 37*b* are not provided, and thus, the positions of the duct 38*b* and the valve 39*c* are different.

Figure 13:
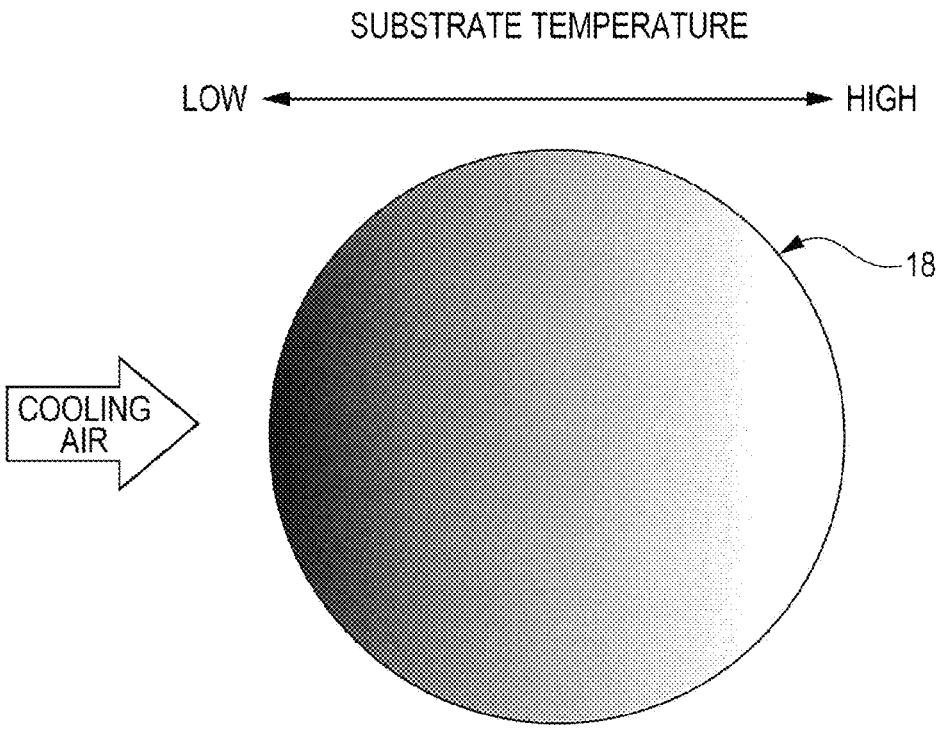
FIG. 13 is a diagram illustrating a temperature distribution of a substrate when cooling was performed using the substrate processing apparatus according to the comparative example.

The substrate processing apparatus 100 includes an outer side heat insulation part 32 in which a cylindrical space 34 is formed outside a heat generation part 30. When performing heat insulator cooling (above-described temperature recovery process), the cooling gas supplied from the cooling gas supply port 36 is discharged from the cooling gas outlet port 43 through the cylindrical space 34. In the inside of the furnace, the cooling gas flows from the upper blowout hole 35 toward the lower cooling gas outlet port 43. As illustrated in FIG. 13, the substrate is locally cooled, and it is difficult to maintain the temperature uniformity at the substrate or between the substrates.

Figure 14:
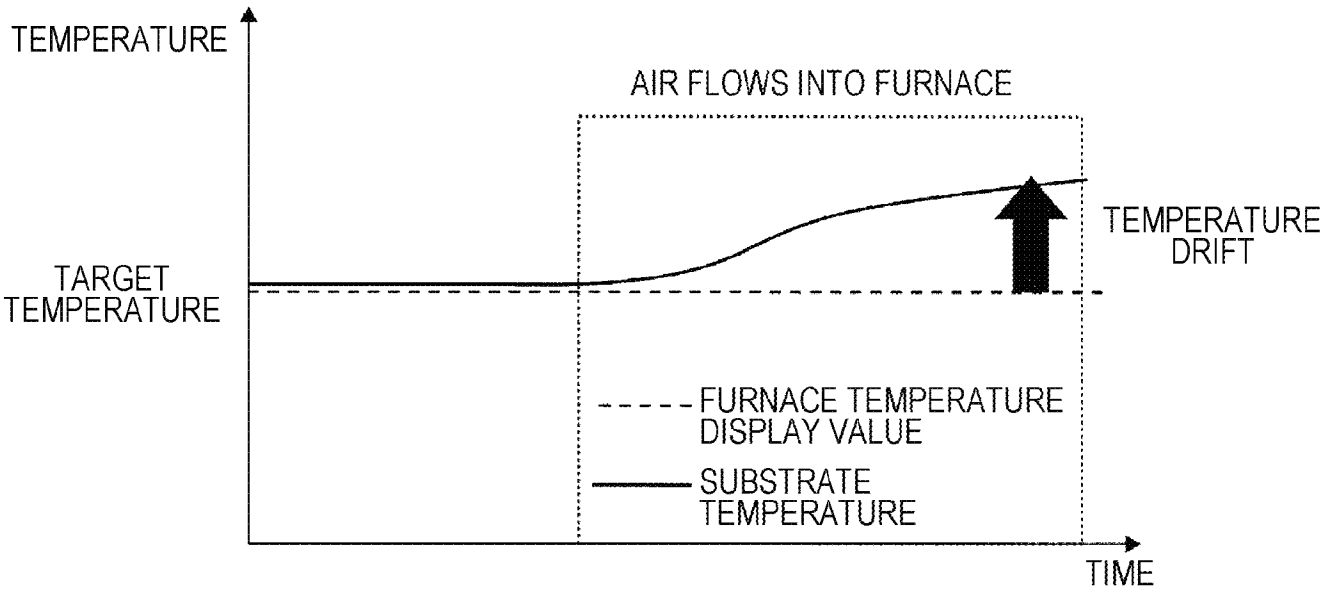
FIG. 14 is a diagram illustrating a furnace temperature characteristic at the time of heat insulator cooling in the substrate processing apparatus according to the comparative example.

FIG. 14 illustrates the furnace temperature characteristic at the time of heat insulator cooling in the substrate processing apparatus 100 of FIG. 12.

When cooling air is introduced into the furnace, the furnace temperature detection part 27 is locally cooled, and a temperature lower than an actual furnace temperature is indicated. A heater output is increased so as to compensate for the furnace temperature drop at the time of temperature stabilization. As a result, there occurs adverse effect, specifically, a drift in the substrate temperature.

Figure 15:
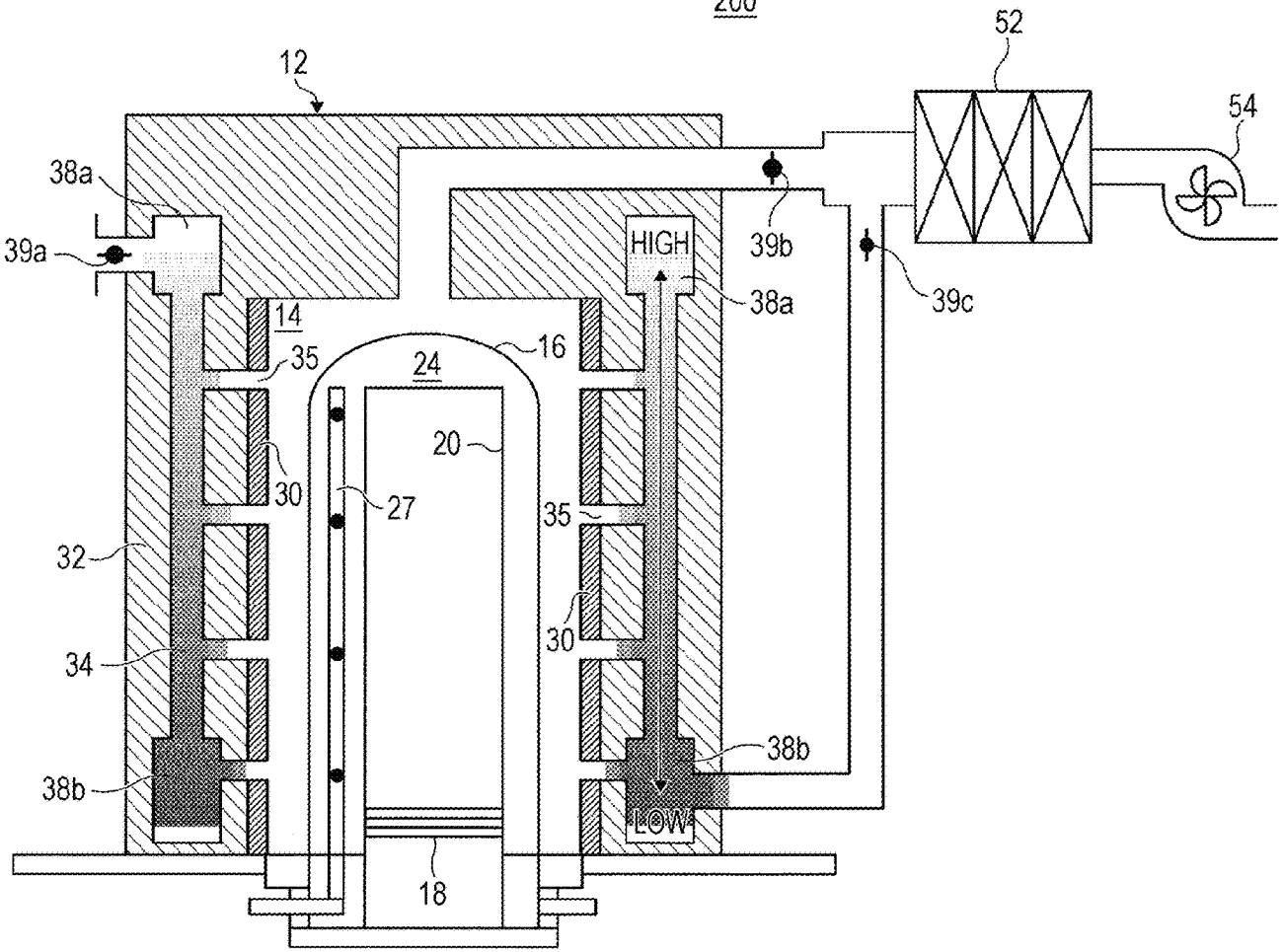
FIG. 15 is a diagram illustrating a temperature distribution inside a cooling gas passage at the time of heat insulator cooling in the substrate processing apparatus according to the comparative example.

FIG. 15 illustrates the temperature distribution inside the cooling gas passage at the time of heat insulator cooling in the substrate processing apparatus of FIG. 12. The temperature distribution inside the cooling gas passage is high in the upper portion and is low in the lower portion.

Figure 16:
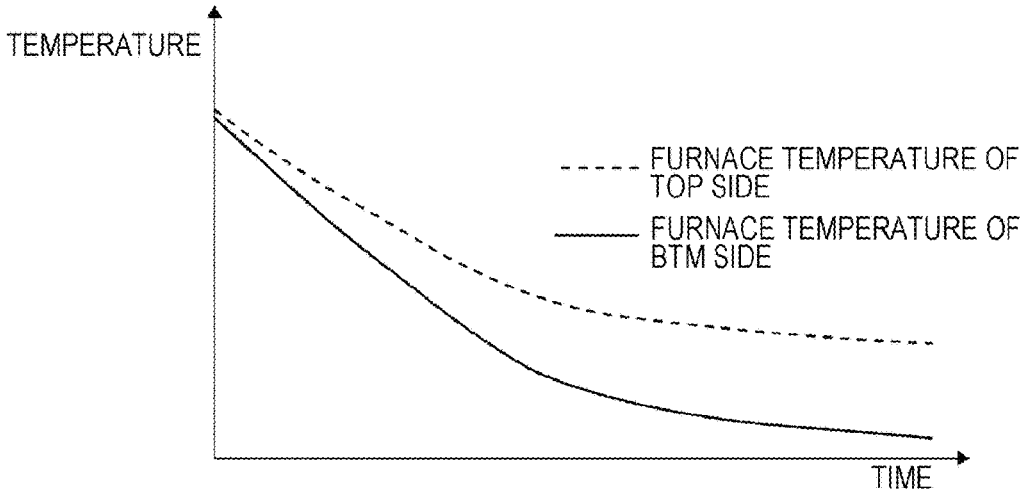
FIG. 16 is a diagram illustrating a temperature lowering characteristic of a furnace in the substrate processing apparatus according to the comparative example.

FIG. 16 illustrates the temperature lowering characteristic of the furnace inner space 14 in a case where the rapid cooling is not performed. When the temperature of the furnace inner space 14 is set as Tf degrees and the temperature of the cylindrical space 34 is set as Ta degrees, the temperature lowering characteristic is better as each temperature difference $\Delta T(Tf-Ta)$ is larger. In the TOP side of the upper portion of the reaction tube 16 and the BTM side of the lower portion of the reaction tube 16, it can be seen that the temperature lowering speed is fast in the BTM side in which the temperature difference $\Delta T$ is large, and the temperature lowering speed is slow in the TOP side in which the temperature difference $\Delta T$ is small.

Therefore, as compared with the first and second comparative examples, the substrate processing apparatus 10 according to the present embodiment uniformly and efficiently cools the furnace, quickly lowers the temperature of the reaction tube 16, and quickly lowers the temperature of the substrate 18 to a predetermined temperature obtained by unloading from the reaction furnace, making it possible to improve throughput and the temperature uniformity at the substrate or between the substrates.

In the present embodiment, the following effects are obtained.

By the temperature control mounted with the heater (heating device 12) with the heat insulator air cooling mechanism according to the present embodiment, the temperature recovery time is shortened, and the productivity is improved by the shortened recipe time. Furthermore, due to the shortened recipe time and the reduced power consumption at the time of stabilization, the energy consumption is reduced to realize energy saving. Further, in the apparatus (substrate processing apparatus 10) mounted with the heater with the heat insulator air cooling mechanism of the present embodiment, since the temperature uniformity of the substrate 18 (in-plane) and the temperature uniformity between the substrates 18 are improved, the product yield is reduced.

Incidentally, the cylindrical heating device 12 is provided in the above-described embodiment, the present invention is not limited thereto. The present invention can be applied to cylindrical heaters having various cross-sectional shapes. Further, the shape of the upper wall part 33 is not also limited to the disk shape. The upper wall part 33 is variously set according to the cross-sectional shape of the heating device 12 so as to cover the upper opening of the heating device 12.

Further, in the present embodiment, the duct 38*a* and the duct 38*b* have been described as being provided in the heating device 12, but the present invention is not limited thereto. The duct 38*a* and the duct 38*b* may be provided outside the apparatus.

Further, the present invention can also be applied to an apparatus for processing a glass substrate such as an LCD device, as well as a semiconductor manufacturing apparatus.

Further, the present invention relates to a semiconductor manufacturing technology, in particular, a heat treatment technology for performing processes in a state heated by a heating device by accommodating a substrate to be processed in a process chamber, and can be effectively applied to a substrate processing apparatus used for an oxidation process or a diffusion process on a semiconductor wafer where a semiconductor integrated circuit device (semiconductor device) is manufactured, and a film forming process by reflow or annealing and a thermal CVD reaction for carrier activation and planarization after ion implantation.

Further, in the present embodiment, the throttle holes 41*a* and the throttle holes 41*b* have been described as being equally formed in plurality in the circumferential direction, but the present invention is not limited thereto. The throttle holes 41*a* and the throttle holes 41*b* may be appropriately changed according to the position and number of the cooling gas supply port 36 or the cooling gas outlet port 43. For example, as the throttle holes 41*a* go away from the cooling gas supply port 36, the number of the throttle holes 41*a* may be increased or the cross-sectional area of the throttle holes 41*a* may be increased, such that the conductance of the throttle holes 41*a* is increased as the throttle holes 41*a* go away from the cooling gas supply port 36. As the throttle holes 41*b* go away from the cooling gas outlet port 43, the number of the throttle holes 41*b* may be increased or the cross-sectional area of the throttle holes 41*b* may be increased, such that the conductance of the throttle holes 41*b* is increased as the throttle holes 41*b* go away from the cooling gas supply port 36.

Due to such a configuration, it is possible to suppress the supply flow rate balance of the cooling gas flowing through the cylindrical space 34 from being changed in each throttle hole 41*a* by difference distances from the cooling gas supply port 36 to each throttle hole 41*a*, and it is possible to provide a uniform supply flow rate of the cooling gas flowing through the cylindrical space 34. Similarly, it is possible to suppress the discharge balance of the discharge flow rate from being changed in each throttle hole 41*a* by different distances from the cooling gas outlet port 43 to each throttle hole 41*b*, and it is possible to provide a uniform supply flow rate of the cooling gas flowing through the cylindrical space 34.

Further, in the present embodiment, the throttle parts 37*a* and 37*b* may be made of the same material or different materials as long as the throttle parts 37*a* and 37*b* are made of a heat insulator.

Further, in the present embodiment, the throttle parts 37*a* and 37*b* may be integrally formed with the side wall part 32 as the heat insulation part or the upper wall part 33 as the heat insulation part, and may be provided as other members.

Further, in the present embodiment, the throttle parts 37*a* and 37*b* have been described as being all provided in both the upper buffer area 38*a* and the lower buffer area 38*b*, but the present invention is not limited thereto. The throttle parts may be provided in only the throttle part 37*a* of the upper buffer area 38*a*.

Due to such a configuration, it is possible to improve temperature uniformity at the time of rapid cooling as compared with the case where the throttle part 37*b* is provided in only the lower buffer area 38*b*.

<Preferred Aspects of the Present Invention>

In the following, preferred aspects of the present invention will be additionally stated.

[Supplementary Note 1]

A heat insulation structure, which has a cylindrical side wall part formed in a multilayer structure, the heat insulation structure including: a cooling gas supply port provided in an upper portion of a side wall outer layer disposed in an outer side of the side wall part; a cooling gas passage provided between a side wall inner layer disposed in an inner side of the side wall part and the side wall outer layer; a space provided in an inner side of the side wall inner layer; a plurality of blowout holes provided in the side wall inner layer to blow out cooling gas from the cooling gas passage to the space; a buffer area continuously provided in the cooling gas supply port and the cooling gas passage; and a throttle part configured to reduce a cross-sectional area of a boundary surface between the buffer area and the cooling gas passage.

[Supplementary Note 2]

A heat insulation structure, which has a cylindrical side wall part formed in a multilayer structure, the heat insulation structure including: a cooling gas supply port provided in an upper portion of a side wall outer layer disposed in an outer side of the side wall part; a cooling gas passage provided between a side wall inner layer disposed in an inner side of the side wall part and the side wall outer layer; a cooling gas outlet port provided in a lower portion of the side wall outer layer disposed in the outer side of the side wall part; a buffer area provided on both ends of the cooling gas passage; and a throttle part configured to reduce a cross-sectional area of a boundary surface disposed in a boundary between the buffer area and the cooling gas passage.

[Supplementary Note 3]

A method for manufacturing a semiconductor device, including: loading a substrate into a reaction tube; processing the substrate inside the reaction tube; and, after the processing, cooling the reaction tube disposed in a space provided in an inner side of the side wall inner layer, by blowing out cooling gas, the cooling gas being supplied from a cooling gas supply port disposed in an upper portion of a side wall outer layer disposed in an outer side of a side wall part of a heat insulation structure having the cylindrical side wall part formed in a multilayer structure, from a plurality of blowout holes to the space provided in the inner side of the side wall inner layer, through a cooling gas passage provided between a side wall inner layer disposed in an inner side of the side wall part and the side wall outer layer, a buffer area continuously provided in the cooling gas supply port and the cooling gas passage, and a throttle part configured to reduce a cross-sectional area of a boundary surface disposed in a boundary between the buffer area and the cooling gas passage.

[Supplementary Note 4]

A method for manufacturing a semiconductor device, including: loading a substrate into a reaction tube; processing the substrate inside the reaction tube; and, after the processing, discharging cooling gas, the cooling gas being supplied from a cooling gas supply port disposed in an upper portion of a side wall outer layer disposed in an outer side of a side wall part of a heat insulation structure having the cylindrical side wall part formed in a multilayer structure, from a cooling gas outlet port provided in a lower portion of the side wall outer layer, through a cooling gas passage provided between a side wall inner layer disposed in an inner side of the side wall part and the side wall outer layer, a buffer area provided on both ends of the cooling gas passage, and a throttle part configured to reduce a cross-sectional area of a boundary surface disposed in a boundary between the buffer area and the cooling gas passage.

[Supplementary Note 5]

The heat insulation structure according to Supplementary Note 1, wherein the throttle part includes a plurality of throttle parts equally disposed in a circumferential direction.

[Supplementary Note 6]

The heat insulation structure according to Supplementary Note 1, wherein a plurality of partition walls is provided between the side wall outer layer and the side wall inner layer in a circumferential direction, and reduces a cross-sectional area of a plurality of cooling gas passages partitioned by the plurality of partition walls.

[Supplementary Note 7]

The heat insulation structure according to Supplementary Note 5 or 6, wherein a cross-sectional area of the throttle part is formed to be smaller than a cross-sectional area of each of the plurality of cooling gas passages.

[Supplementary Note 8]

The heat insulation structure according to Supplementary Note 1, wherein the throttle part includes at least two throttle parts provided in a vertical direction.

[Supplementary Note 9]

The heat insulation structure according to Supplementary Note 8, wherein the throttle part includes a first throttle part and a second throttle part, and a cross-sectional area of the first throttle part is formed to be smaller than a cross-sectional area of the second throttle part.

[Supplementary Note 10]

The heat insulation structure according to Supplementary Note 9, wherein the first throttle part is provided above the blowout hole disposed at the top, and the second throttle part is provided below the blowout hole disposed at the bottom.

[Supplementary Note 11]

The heat insulation structure according to Supplementary Note 1, wherein a cooling gas outlet port is provided in a lower portion of a side wall outer layer disposed in an outer side of a plurality of layers of the side wall part, and a second throttle part is provided in a boundary between the cooling gas outlet port and the cooling gas passage and reduces a cross-sectional area of the cooling gas outlet port.

[Supplementary Note 12]

The heat insulation structure according to Supplementary Note 1, wherein a valve is provided in the vicinity of at least each throttle part, and the valve is opened and closed according to a temperature control state (mode).

[Supplementary Note 13]

The heat insulation structure according to Supplementary Note 1, wherein a buffer area is provided to distribute cooling gas flowing through the cooling gas passage.

[Supplementary Note 14]

The heat insulation structure according to Supplementary Note 1, wherein an exhaust fan is provided to exhaust cooling gas flowing through the cooling gas passage.

[Supplementary Note 15]

A heating device including: a heat insulation structure of Supplementary Note 1; and a heat generation part.

[Supplementary Note 16]

A substrate processing apparatus including a heating device of Supplementary Note 15.

[Supplementary Note 17]

A temperature control method including at least cooling a reaction tube disposed in a space provided in an inner side of the side wall inner layer, by blowing out cooling gas, the cooling gas being supplied from a cooling gas supply port disposed in an upper portion of a side wall outer layer disposed in an outer side of a side wall part of a heat insulation structure having the cylindrical side wall part formed in a multilayer structure through a throttle part reducing a cross-sectional area, from a plurality of blowout holes disposed below the cooling gas supply port of the side wall inner layer to the space provided in the inner side of the side wall inner layer through a cooling gas passage provided between the side wall inner layer and the side wall outer layer.

[Supplementary Note 18]

The heat insulation structure according to Supplementary Note 2, wherein the throttle part includes a plurality of throttle parts equally disposed in a circumferential direction.

[Supplementary Note 19]

The heat insulation structure according to Supplementary Note 2, wherein a plurality of partition walls is provided between the side wall outer layer and the side wall inner layer in a circumferential direction, and reduces a cross-sectional area of a plurality of cooling gas passages partitioned by the plurality of partition walls.

[Supplementary Note 20]

The heat insulation structure according to Supplementary Note 18 or 19, wherein a cross-sectional area of the throttle part is formed to be smaller than a cross-sectional area of each of the plurality of cooling gas passages.

[Supplementary Note 21]

The heat insulation structure according to Supplementary Note 20, wherein the first throttle part is provided above the blowout hole disposed at the top, and the second throttle part is provided below the blowout hole disposed at the bottom.

[Supplementary Note 22]

The heat insulation structure according to Supplementary Note 21, wherein the throttle part includes a first throttle part and a second throttle part, and a cross-sectional area of the first throttle part is formed to be smaller than a cross-sectional area of the second throttle part.

[Supplementary Note 23]

The heat insulation structure according to Supplementary Note 2, wherein a valve is provided in the vicinity of at least each throttle part, and the valve is opened and closed according to a temperature control state (mode).

[Supplementary Note 24]

The heat insulation structure according to Supplementary Note 2, wherein an exhaust fan is provided to exhaust cooling gas flowing through the cooling gas passage.

[Supplementary Note 25]

A heating device including: a heat insulation structure of Supplementary Note 2; and a heat generation part.

[Supplementary Note 26]

A substrate processing apparatus including a heating device of Supplementary Note 25.

[Supplementary Note 27]

A temperature control method including at least exhausting cooling gas, the cooling gas being supplied from a cooling gas supply port disposed in an upper portion of a side wall outer layer disposed in an outer side of a side wall part of a heat insulation structure having the cylindrical side wall part formed in a multilayer structure through a throttle part reducing a cross-sectional area, through a second throttle part reducing a cross-sectional area from a cooling gas outlet port disposed in a lower portion of the side wall part, through a cooling gas passage disposed between a side wall inner layer disposed in an inner side of the side wall part and the side wall outer layer.

FIG. 3

S1: MAINTAIN AT TARGET TEMPERATURE T0
S2: LOAD BOAT
S3: GRADUALLY RAISE TEMPERATURE
S4: MAINTAIN AT TARGET TEMPERATURE T1
S5: GRADUALLY LOWER TEMPERATURE
S6: UNLOAD BOAT

FIG. 4

FURNACE TEMPERATURE
TIME

FIG. 8

27-1 TO 27-4
60: CONTROL DEVICE
62: GAS FLOW RATE ADJUSTMENT DEVICE
64: FLOW RATE SENSOR
66: PRESSURE ADJUSTMENT DEVICE
68: PRESSURE SENSOR
70-1 TO 70-4
72-1 TO 72-4
HEATER U
TEMPERATURE SENSOR
HEATER CU
HEATER CL
HEATER L
74: TEMPERATURE CONTROL DEVICE
76-1 TO 76-4
HEATER DRIVING DEVICE U
HEATER DRIVING DEVICE CU
HEATER DRIVING DEVICE CL
HEATER DRIVING DEVICE L
78: FLOW RATE CONTROL DEVICE
80: PRESSURE CONTROL DEVICE
TO CONTROL COMPUTER 82

FIG. 9

86: MEMORY
88: COMPUTER MAIN BODY
92: STORAGE DEVICE

FIG. 11

TEMPERATURE
TARGET TEMPERATURE
HEATING DEVICE 12*a*
HEATING DEVICE 12*b*
TIME

FIG. 13

LOW
HIGH
SUBSTRATE TEMPERATURE
COOLING AIR

FIG. 14

TEMPERATURE
TARGET TEMPERATURE
AIR FLOWS INTO FURNACE
TEMPERATURE DRIFT
FURNACE TEMPERATURE DISPLAY VALUE
SUBSTRATE TEMPERATURE
TIME

FIG. 15

HIGH
LOW

FIG. 16

TEMPERATURE
FURNACE TEMPERATURE OF TOP SIDE
FURNACE TEMPERATURE OF BTM SIDE
TIME

What is claimed is:

1. A heat insulation structure, which has a cylindrical side wall part formed in a multilayer structure, the heat insulation structure comprising:

a cooling gas supply port provided in an upper portion of a side wall outer layer disposed in an outer side of the side wall part;

a cooling gas passage provided between a side wall inner layer disposed in an inner side of the side wall part and the side wall outer layer;

a space provided in an inner side of the side wall inner layer;

a plurality of blowout holes provided in the side wall inner layer for distributing cooling gas from the cooling gas passage to the space;

a buffer area continuously provided in the cooling gas supply port and the cooling gas passage; and a throttle part configured to reduce a cross-sectional area of a boundary surface between the buffer area and the cooling gas passage.

2. The heat insulation structure according to claim 1, wherein the throttle part includes a plurality of throttle parts equally disposed in a circumferential direction.

3. The heat insulation structure according to claim 1, wherein a plurality of partition walls is provided between the side wall outer layer and the side wall inner layer in a circumferential direction, and reduces a cross-sectional area of a plurality of cooling gas passages partitioned by the plurality of partition walls.

4. The heat insulation structure according to claim 3, wherein a cross-sectional area of the throttle part is formed to be smaller than a cross-sectional area of each of the plurality of cooling gas passages.

5. The heat insulation structure according to claim 1, wherein the throttle part includes at least two throttle parts provided in a vertical direction.

6. The heat insulation structure according to claim 5, wherein the throttle part includes a first throttle part and a second throttle part, and a cross-sectional area of the first throttle part is smaller than a cross-sectional area of the second throttle part.

7. The heat insulation structure according to claim 6, wherein the first throttle part is provided above a blowout hole disposed at the top, and the second throttle part is provided below a blowout hole disposed at the bottom.

8. The heat insulation structure according to claim 1, wherein a cooling gas outlet port is provided in a lower portion of a side wall outer layer disposed in an outer side of a plurality of layers of the side wall part, and a second throttle part is provided in a boundary between the cooling gas outlet port and the cooling gas passage and reduces a cross-sectional area of the cooling gas outlet port.

9. The heat insulation structure according to claim 1, wherein a valve is provided in the vicinity of at least each throttle part, and the valve is opened and closed according to a temperature control state or mode.

10. The heat insulation structure according to claim 1, wherein a buffer area is provided to distribute cooling gas flowing through the cooling gas passage.

11. The heat insulation structure according to claim 1, wherein an exhaust fan is provided to exhaust cooling gas flowing through the cooling gas passage.

12. A heating device comprising:

a heat insulation structure of claim 1; and a heat generation part.

13. A substrate processing apparatus comprising:

a heating device of claim 12.

14. A heat insulation structure, which has a cylindrical side wall part formed in a multilayer structure, the heat insulation structure comprising:

a cooling gas supply port provided in an upper portion of a side wall outer layer disposed in an outer side of the side wall part;

a cooling gas passage provided between a side wall inner layer disposed in an inner side of the side wall part and the side wall outer layer;

a cooling gas outlet port provided in a lower portion of the side wall outer layer disposed in the outer side of the side wall part;

a buffer area provided on both ends of the cooling gas passage; and a throttle part configured to reduce a cross-sectional area of a boundary surface disposed in a boundary between the buffer area and the cooling gas passage.

15. The heat insulation structure according to claim 14, wherein a plurality of partition walls is provided between the side wall outer layer and the side wall inner layer in a circumferential direction, and reduces a cross-sectional area of a plurality of cooling gas passages partitioned by the plurality of partition walls.

16. The heat insulation structure according to claim 15, wherein a cross-sectional area of the throttle part is smaller than a cross-sectional area of each of the plurality of cooling gas passages.

17. The heat insulation structure according to claim 16, wherein the first throttle part is provided above a blowout hole disposed at the top, and the second throttle part is provided below a blowout hole disposed at the bottom.

18. A heating device comprising:

a heat insulation structure of claim 14; and a heat generation part.

19. A substrate processing apparatus comprising:

a heating device of claim 18.

20. A method for manufacturing a semiconductor device, comprising:

loading a substrate into a reaction tube;

processing the substrate inside the reaction tube; and, after the processing, cooling the reaction tube disposed in a space provided in an inner side of the side wall inner layer, by distributing cooling gas, the cooling gas being supplied from a cooling gas supply port disposed in an upper portion of a side wall outer layer disposed in an outer side of a side wall part of a heat insulation structure having the cylindrical side wall part formed in a multilayer structure, from a plurality of blowout holes to the space provided in the inner side of the side wall inner layer, through a cooling gas passage provided between a side wall inner layer disposed in an inner side of the side wall part and the side wall outer layer, a buffer area continuously provided in the cooling gas supply port and the cooling gas passage, and a throttle part configured to reduce a cross-sectional area of a boundary surface disposed in a boundary between the buffer area and the cooling gas passage.

* * * * *